US005691522A

United States Patent [19]

Schulman et al.

[11] Patent Number: 5,691,522

[45] Date of Patent: Nov. 25, 1997

[54] VACUUM INTERRUPTER WITH A SINGLE INTERNAL ASSEMBLY FOR GENERATING AN AXIAL MAGNETIC FIELD

[75] Inventors: Michael Bruce Schulman; Paul G. Slade, both of Ithaca, N.Y.

[73] Assignee: Eaton Corporation, Cleveland, Ohio

[21] Appl. No.: 488,401

[22] Filed: Jun. 7, 1995

[51] Int. Cl.[6] ..... H01H 33/66

[52] U.S. Cl. ..... 218/128; 218/129

[58] Field of Search ..... 218/118–122, 123–129, 218/130–140, 146

[56] References Cited

U.S. PATENT DOCUMENTS

| | | | |
|---|---|---|---|
| 4,117,288 | 9/1978 | Gorman et al. | 218/129 |
| 4,260,864 | 4/1981 | Wayland et al. | 218/129 |
| 4,271,340 | 6/1981 | Griesen | 218/129 |
| 4,367,382 | 1/1983 | Suzuki et al. | 218/129 |
| 4,451,813 | 5/1984 | Hirose et al. | 218/129 X |
| 4,459,446 | 7/1984 | Wolf | 218/146 X |
| 4,620,074 | 10/1986 | Paul et al. | 218/128 |
| 4,636,600 | 1/1987 | Lipperts | 218/129 |
| 4,675,483 | 6/1987 | Gebel et al. | 218/129 |
| 4,717,797 | 1/1988 | Hoene | 218/129 |
| 4,798,921 | 1/1989 | Watanabe | 218/127 |
| 5,099,093 | 3/1992 | Schels et al. | 218/128 |
| 5,461,205 | 10/1995 | Schulman | 218/123 |

*Primary Examiner*—J. R. Scott
*Attorney, Agent, or Firm*—Martin J. Moran

[57] ABSTRACT

An axial magnetic field vacuum interrupter includes a field producing structure associated with only one of two opposing electrode assemblies. The field producing structure is characterized in that when the instantaneous peak arc current is $I_m$, measured in kiloamperes, and the electrode assemblies are in the open circuit position, the instantaneous component of the axial magnetic filed (AMF) B in the axial direction $B_a$, measured in milliteslas, imposed on the majority of each electrode contact surface is given by the analytical expression.

$$5I_m \frac{\text{mT}}{\text{kA}} > B_a \geqq 3.2(I_m - 9\text{kA}) \frac{\text{mT}}{\text{kA}}$$

6 Claims, 3 Drawing Sheets

VACUUM INTERRUPTER WITH A SINGLE INTERNAL ASSEMBLY FOR GENERATING AN AXIAL MAGNETIC FIELD

BACKGROUND OF THE INVENTION

1. Field of the Invention

The invention relates to designs of axial magnetic field vacuum interrupters, and, in particular, to a vacuum interrupter having a single internal assembly associated with one of a pair of contacting electrodes for generating the magnetic field.

2. Description of the Prior Art

Vacuum interrupters for interrupting large ac currents of the order of tens of kiloamps typically include two relatively movable electrode assemblies, or contact assemblies, that are located within a vacuum envelope. During current conduction, when the electrode assemblies move from a normally closed circuit position, wherein a contact face of each of the assemblies abuts the contact face of other, to an open circuit position, wherein the contact gap between the contact faces is generally less than one inch, an arc is typically formed in the contact gap between the contact faces before the current is extinguished. In axial magnetic field (AMF) vacuum interrupters, an axial magnetic field is generated in the contact gap. The field acts to force an initially columnar, high-current vacuum arc to rapidly become diffuse and continuously distributed within the contact gap, so that the anode contact is merely a passive collector of diffuse current. This ability to produce high-current diffuse arcing gives the device a superior interruption ability.

In one type of AMF vacuum interrupter, internal structures that are assembled as parts of each of the arcing contacts direct the current so as to produce the axial magnetic (AM) field B. B is a function of the current I, the axial position z, the separation d of the contacts, and the geometry of the assemblies which produce the AMF. (To simplify the description, we do not consider the radial variation of B.) In practice, prior-art commercial AMF vacuum interrupters with AMF contacts have generally employed the same geometry of AMF producing structure in both the electrode assemblies, so the impressed AMF is the same at both contact surfaces, and it is symmetric about the center plane of the contact gap. The B thus produced is proportional to the instantaneous current I. Some commercially important examples of prior-art AMF contact designs are described in U.S. Pat. Nos. 4,260,864, 4,367,382, and 4,620,074.

There are negative aspects to this prior art for constructing AM vacuum interrupters. Because of their more complicated geometry, the AM contact assemblies are to some degree more difficult and more costly to manufacture than non-AM contacts. The AM contact assemblies are associated with an additional impedance that is counter to the goal of low total impedance for the vacuum interrupter. The additional impedance causes an additional heat rise in the AM contact assemblies during current conduction. This is counter to the goal of low heat production in the interrupter. This heat rise is partly the result of eddy currents which the sinusoidal AM field induces in the conducting structures within the vacuum interrupter. These eddy currents are also undesirable because they act to reduce the magnitude of the net B and increase its phase delay from the main current. Methods of reducing eddy currents, such as that described in co-owned U.S. Pat. No. 5,461,205, often involve added complexity in the geometry of the contacts or electrodes.

There is therefore a need for an axial magnetic field vacuum interrupter that is economical, simple to construct, and effective in interrupting large ac currents, and that does not suffer the disadvantages and defects of the prior art devices.

SUMMARY OF THE INVENTION

It is an object of the invention to provide an axial magnetic field vacuum interrupter that has a lower impedance than prior art designs.

It is another object of the invention to provide an AM field vacuum interrupter that minimizes eddy current heating in the interrupter without adding more complexity to the contacts and the field producing structure.

It is another object of the invention to provide an AM field vacuum interrupter that produces a minimal magnetic field necessary to interrupt a current.

These objects and others are obtained according to the invention, with a vacuum interrupter having a maximum interruption capability of peak current $I_m$, the interrupter including first and second coaxially aligned electrode assemblies that are relatively movable along a longitudinal direction defined by a common axis between an open circuit and a closed circuit position, each electrode assembly including a contact surface confronting the contact surface of the other electrode assembly. Only the first electrode assembly includes an axial magnetic field (AMF) assembly through which some or all of the main current I flows for producing a magnetic field B in a contact gap between the contact surfaces. The AMF assembly is configured such that when the instantaneous arc current I is at its peak value of $I_m$, measured in kiloamperes (kA), and the electrode assemblies are in the open circuit position, the instantaneous component of B in the axial direction $B_a$, measured in milliteslas (mT), imposed on and between the majority of each of the contact surfaces is characterized by $$5\frac{\text{mT}}{\text{kA}}\ I_m > B_a \geqq 3.2\frac{\text{mT}}{\text{kA}}\ (I_m - 9\text{kA}). \qquad [1]$$

According to another aspect of the invention, the AMF assembly includes a generally annular-shaped effective coil having an average radius a and that comprises N circumferentially spaced coil segments, each segment having a midpoint of axial thickness spaced an average distance $Z_O$ in the axial direction from the contact surface, the segments defining N substantially identical parallel current paths through which approximately equal branch currents Γ of the interrupter current I flow before entering the contact surface of the first electrode assembly, and a low current leakage path through which a branch current αΓ of the interrupter current I flows before entering the contact surface of the first electrode assembly, αΓ being less than Γ through any of the segments, the vacuum interrupter being structured such that:

$$\frac{a^2}{[a^2+(z_0+d)^2]^{1.5}} \geqq 5.09\text{m}^{-1}\frac{(N+\alpha)}{\cos\phi}\left[1-9\frac{kA}{I_m}\right] \qquad [2]$$

where the contact gap in the open circuit position is d, where φ is the eddy current induced phase shift of $B_a$ from I, where a, $z_o$ and d are measured in meters, and where $I_m$ is measured in kA.

In an exemplary embodiment of the invention, the effective coil segments are generally circularly shaped, each of the segments being generally coplanar and circumferentially spaced apart. In one embodiment, the vacuum interrupter is structured such that a is approximately 0.033 m, $z_o$ is approximately 0.0164 m, N is 2, φ is approximately 37°, α is approximately 0.123, $I_m$ is about 51 kA, and d is less than or equal to approximately 0.0128 m.

In another exemplary embodiment of the invention, the coil is structured such that the segments define N circumferentially spaced slots each inclined at a pitch angle θ to the longitudinal axis such that each segment overlaps an adjacent segment, the vacuum interrupter being structured such that:

$$\frac{a^2}{[a^2+(z_0+d)^2]^{1.5}} \geq \frac{5.09\text{m}^{-1}}{k(\theta)} \frac{(N+\alpha)}{\cos\phi}\left[1-\frac{9\text{kA}}{I_m}\right] \quad [3]$$

where k(θ) ranges between 1.0 and 1.2. In one embodiment, d is approximately 0.008 meters, N=6, and k(θ) is approximately 1.078.

The foregoing objects and aspects of the invention will be more fully understood from the following description of the invention with reference to exemplary embodiments as illustrated in the drawings appended hereto.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within he scope of the appended claims.

DETAILED DESCRIPTION OF THE INVENTION

Figure 1:
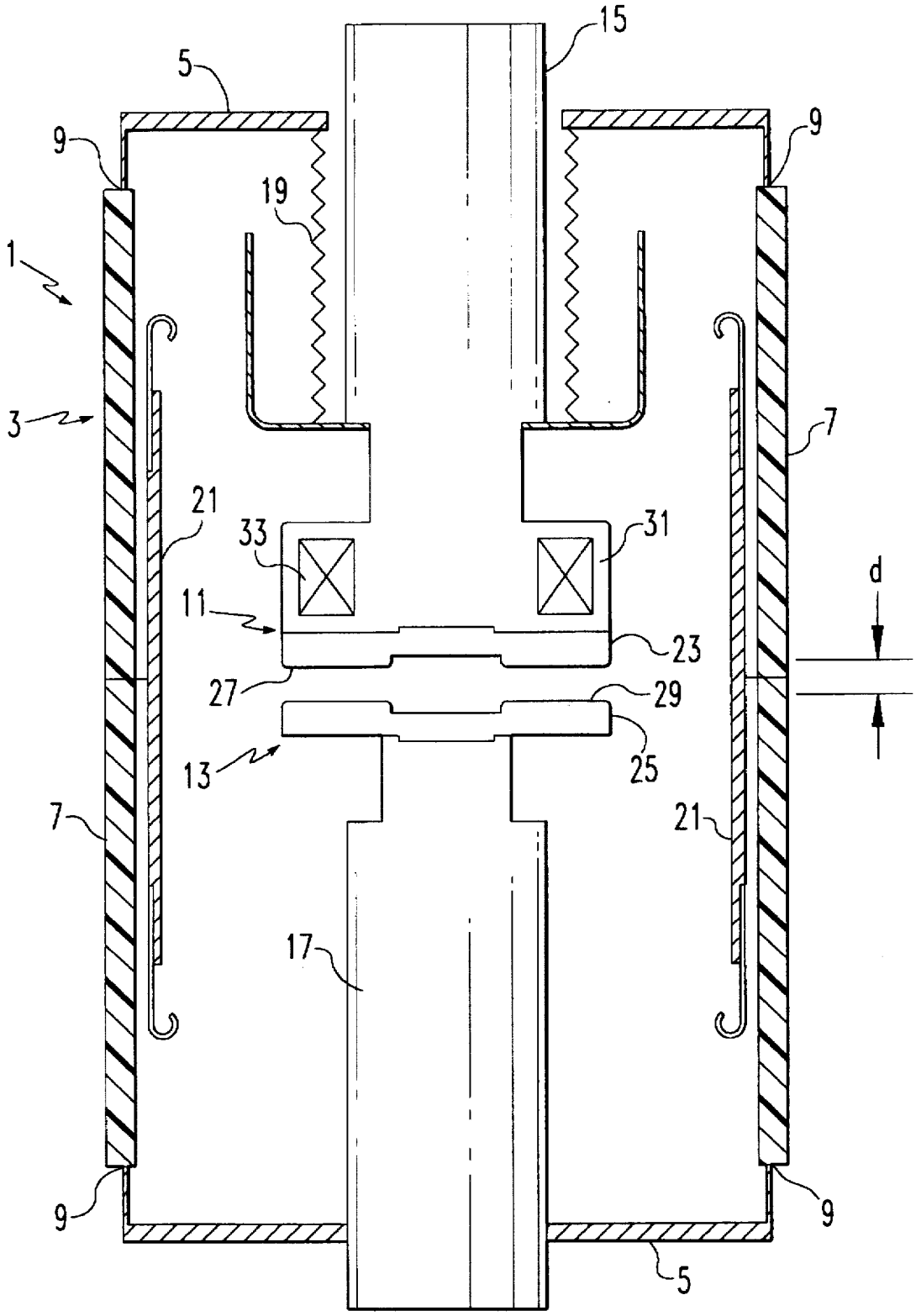
FIG. 1 is a schematic illustration of a vacuum interrupter according to the invention in a partial longitudinal sectional view.

FIG. 1 schematically illustrates the principal components of an axial magnetic field (AMF) vacuum interrupter 1 according to the invention, shown in a broken away view in partial cross section. A vacuum envelope 3 enclosing the generally coaxially aligned internal components includes spaced apart end caps 5 and a tubular, insulating casing 7 joined together by metal-to-insulation vacuum seals 9. The envelope is typically evacuated to a pressure of about $10^{-6}$ Torr during use. Located within the envelope are a first electrode assembly 11 and a second electrode assembly 13, shown here in their open circuit position. The electrode assemblies 11, 13 are electrically coupled to and supported from first and second electrode stems 15, 17, respectively, that provide electrical connection to an electric circuit (not shown) outside the interrupter 1. A bellows assembly 19 incorporated with a movable one of the stems 15 allows the electrode assemblies 11, 13 to be relatively movable in a longitudinal direction, defined by a common axis of the electrode assemblies 11, 13, between a closed circuit position (not shown) wherein they are in contact with each other and the open circuit position. Spaced apart from and generally surrounding the first and second electrode assemblies 11, 13 is a generally cylindrical metal vapor condensing shield 21 as is well known in the art. First electrode assembly 11 includes a first electrode contact 23, and second electrode assembly 13 includes a second electrode contact 25, that have contact surfaces 27, 29, respectively, that confront the contact surface of the other electrode contact. The distance between the contact surfaces 27, 29 is defined as the contact gap, and has a maximum value d in the open circuit position, which is illustrated in FIG. 1.

Typical AMF vacuum interrupters of the prior art are structured symmetrically in that each electrode includes a coil-like structure energized by the interrupter current for producing the AMF. In contrast, vacuum interrupter 1 is structured asymmetrically in that only first electrode assembly 11 includes an axial magnetic field assembly (AMF assembly) 31 that includes field producing structure, such as coil 33, for producing the axial magnetic field (AMF) when energized by the interrupter current. The second electrode assembly 13 does not include an AMF assembly. This reduces complexity, cost, impedance, heat rise, and eddy currents from prior art designs, which typically include structure coupled with each electrode assembly for producing the AMF. It will be understood that the AMF assembly can be incorporated into one of either the movable electrode assembly or the fixed electrode assembly.

Vacuum interrupters are typically rated with a maximum peak interruption current $I_m$ and a maximum circuit voltage. The minimum acceptable AMF is used as the criterion for determining the parameters of the AMF assembly 31 in terms of $I_m$ and d, the separation of the contact surfaces 27, 29 in the open circuit position. If the current rating is specified as $I_{rms}$, then $I_m=(\sqrt{2})\ I_{rms}$. It is desirable to minimize the AMF within its acceptable bounds, since contact designs which produce larger than necessary axial magnetic fields will result in greater than necessary complexity, cost, impedance, heat transfer and eddy currents.

There is a critical, or minimum, magnitude of the AMF for elimination of harmful anode activity. This critical AMF value increases linearly with the arc current. The minimum acceptable AMF within the contact gap is specified in terms of the maximum peak current to be interrupted, $I_m$, when the contact gap is at its maximum specified value d.

According to the invention, AMF assembly 31 is configured such that when the instantaneous arc current is $I_m$ (in kA) and the contact gap is fully open with a separation d, then the instantaneous axial component of the magnetic field B (in millitesla) imposed by the AMF assembly on and between the majority of both contact surfaces 27, 29 of contacts 23, 25, respectively, is consistent with the relation $$\frac{5\text{mT}}{\text{kA}} I_m > B_a \geq \frac{3.2\text{mT}}{\text{kA}} (I_m - 9\text{kA}). \quad [4]$$

The geometry of electrode assembly 11 can be expressed as an analytical function of $I_m$, d and the geometry of the AMF assembly 31, in the case for which the structure which produces the AMF (i.e. the AMF assembly 31) is located behind the plane of the contacting surface 27 of first electrode assembly 11. In this case the AMF strength decreases monotonically with axial distance along the contact gap, in the direction away from AMF assembly 31 and first electrode assembly 11. Then the specification in Equation 4 becomes a specification that at the instant when $I=I_m$, the axial magnetic field B imposed by the AMF assembly on the axial region of the contacting surface 29 of second electrode contact 25 is given by Eqn. 4, where $I_m$ is in kA.

Figure 2:
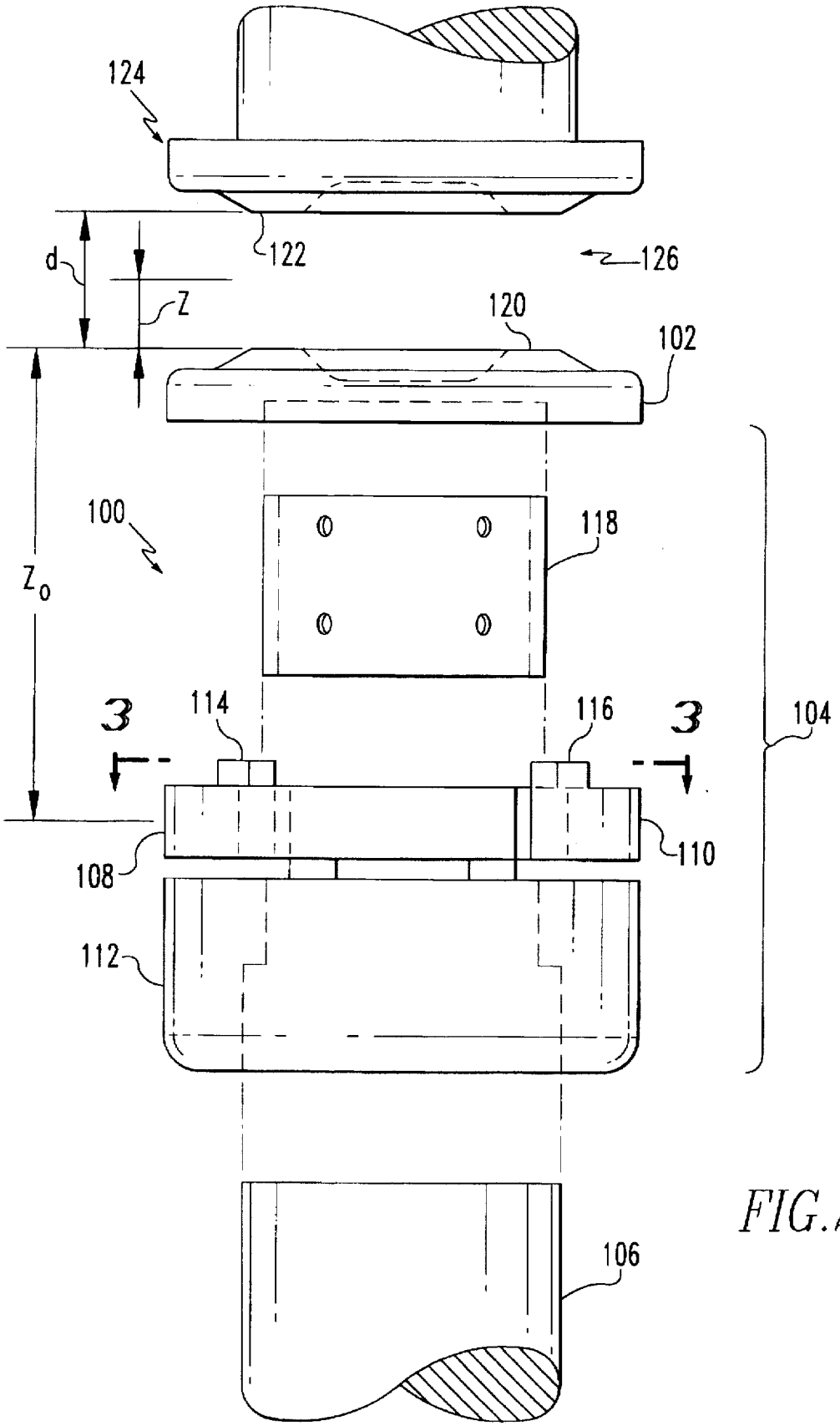
FIG. 2 is an exploded view of an electrode assembly incorporating a segmented coil for producing an axial magnetic field.
Figure 3:
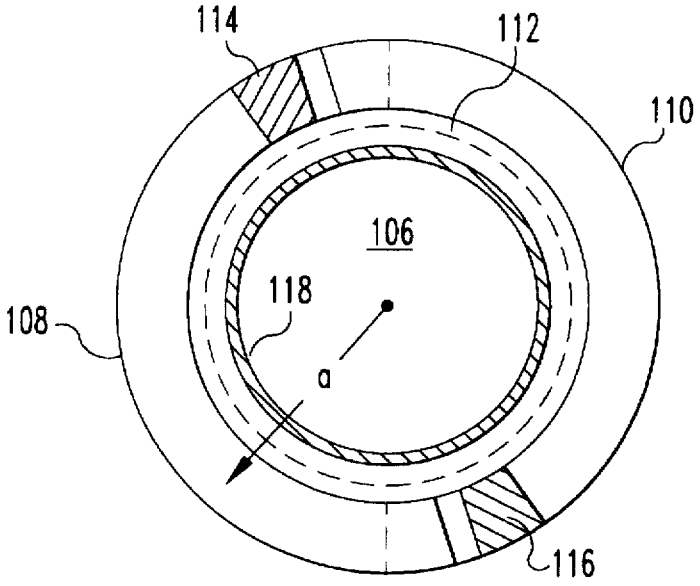
FIG. 3 is a sectional view through line 3—3 of FIG. 2.

In the case where AMF assembly 31 includes an effective coil structure with a plurality of arcuate segments, the specification of the geometry of the first electrode assembly 11 can be expressed as an analytical function of $I_m$ and d. This includes the case for which there are, for example, N identical arcuate coil segments, through which equal fractions of the main current flow before entering the contacting surface of the first electrode contact. FIGS. 2 and 3 illustrate an example of this type of electrode assembly, FIG. 2 being an exploded side view and FIG. 3 being a sectional view through FIG. 2.

Electrode assembly 100 includes a butt-type electrode contact 102 and AMF assembly 104 coupling between electrode stem 106 and electrode contact 102. AMF assembly 104 includes first and second coil segments 108, 110 that each extend circumferentially almost 180 degrees. A generally annular-shaped base 112 supports first and second coil segments 108, 110 and couples to the electrode stem 106. Electrical contact between the first and second coil segments 108, 110 and electrode contact 102 is provided by posts 114 and 116, respectively. Additional support for contact 102 is provided by cylindrically-shaped support 118. Contact 102 has a contacting surface 120 that confronts the contacting surface 122 of the non-field producing second electrode assembly 124.

First and second coil segments 108, 110 provide two parallel branch current paths. A low-conductivity path through which a fraction of the current by-passes the field coil segments 108, 110 is provided by support 118, this fraction being less than the fraction through any of the field-coil segments. Although AMF assembly 104 includes only two field coil segments, it is understood that a single circular field coil extending about 360 degrees or more than two field coil segments can be incorporated into the AMF assembly.

Returning now to the general case of N field coil segments (e.g. first and second coil segments 108, 110) in the AMF assembly, and for the specific case when the field-coil segments are equivalent, let Γ be the current through one segment, and let αΓ be the current through the leakage path (e.g. support 118), where $0<\alpha<1$. Then the total current is $I=(N+\alpha)\Gamma$. Let z be the axial distance measured from the plane of contacting surface (120) to an axial position in the gap 126, so that $0\leqq z\leqq d$. Let $z_o$ be the axial distance from the center of the segmented coil to the plane of the contacting surface 120 of the contact 102. Let a be the average coil-segment radius.

Assume that due to eddy current effects, the axial magnetic field B lags the current I by a phase shift φ. Then $$B=\frac{0.5\,a^2\mu_0 I\cos\phi}{(N+\alpha)\,[a^2+(z_0+z)^2]^{1.5}} \qquad [5]$$

where B is in teslas, $\mu_o=4\pi\times10^{-7}$ N/A$^2$, I is in amperes, and the dimensions of quantities (a, $z_o$ and z) are in meters.

For $I=I_m$ (in kA) and z=d, and expressing B in milliteslas, the specification in Eqn. 5 becomes $$B=\frac{0.5\,a^2\mu_0 I_m\cos\phi}{(N+\alpha)\,[a^2+(z_0+d)^2]^{1.5}} \geqq \frac{3.2\text{mT}}{\text{kA}}\,[I_m-9\text{kA}]$$

Rearranging terms, the specification of the dimensions of this innovative contact assembly becomes $$\frac{a^2}{[a^2+(z_0+d)^2]^{1.5}} \geqq 5.09\text{m}^{-1}\left[1-\frac{9\text{kA}}{I_m}\right]\frac{(N+\alpha)}{\cos\phi}$$

As an example, consider the case of one 3-inch diameter AMF contact assembly similar to the design illustrated in FIGS. 2 and 3, used with an opposing butt-type contact. In that case, a=0.033 m, $z_o$=0.0164 m, N=2 and α=0.123. From a finite-element electromagnetic field analysis, we have determined that the phase shift for this AM contact assembly is φ=37°. We have also determined that for $I_m=5.1\times10^4$ A, this configuration should satisfy Eqn. 7 if d≦0.0128 m. Substituting these quantities into Eqn. 7, we obtain 12.75≧11.14, so this is a successful configuration for this peak current and maximum gap.

Figure 4:
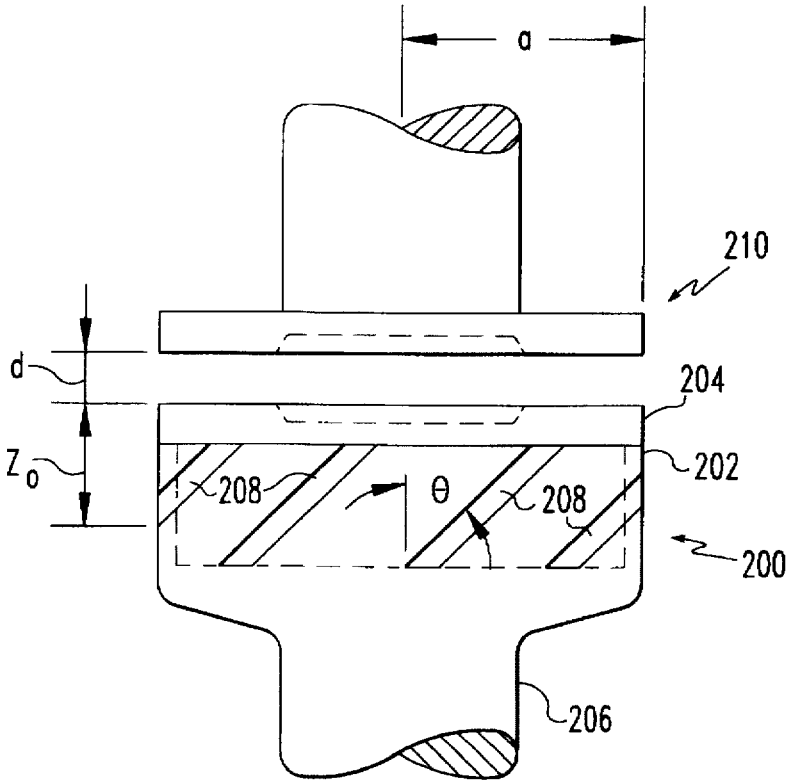
FIG. 4 illustrates an electrode assembly incorporating a slotted cup arrangement for producing an axial magnetic field.

The specification on the geometry of the AMF contact assembly can also be expressed as an analytical function of $I_m$, d and the geometry of the AMF contact assembly, when the AMF is produced by a cup-type contact having a hollow-cylindrical contact carrier with N slots inclined in the same sense to the longitudinal axis of the contact arrangement. Such an arrangement is illustrated in FIG. 4. A first electrode assembly 200 includes an AMF assembly in the form of a slotted cup 202 electrically coupling between an electrode contact plate 204 and an electrode stem 206. Slots 208 create an effective segmented coil for generating an axial component B of the magnetic field. Let a be the average radius of the slotted region, and let $z_o$ be the average height of the slots plus the thickness of the contact 204. Again, d is the maximum gap between the electrode assembly 200 and an opposing non-AMF contact assembly 210.

To a first approximation, the slotted-cup arrangement can be modeled as a segmented field coil, similar to the case analyzed hereinbefore in the discussion with reference to FIGS. 2 and 3. For the optimum range of slot angles θ, the actual AMF will be slightly larger than that implied by Eqn. 5 because of the overlap of the inclined slots. Let the proper correction factor be k(θ), which is typically on the order of 1.1.

Applying the same analysis as that which resulted in Eqn. 7, we obtain the following specification for the dimensions of this contact assembly:

$$\frac{a^2}{[a^2+(z_0+d)]^{1.5}} \geqq \frac{5.09}{k(\theta)}\;\frac{(I_m-9\text{kA})(N+\alpha)\text{m}^{-1}}{I_m\cos\phi} \qquad [8]$$

As an example, consider the case of the interrupter with a slotted-cup contact arrangement described in U.S. Pat. No. 4,620,074. It describes opposing contacts each having a slotted-cup AMF producing structure. For the geometry described therein, a=0.0415 m, $z_o$=0.0105 m, d=0.015 m, N=6 and θ=75°. At the center of the contact gap, the total AMF due to the two AMF assemblies is 4.2 μT/A, which is above their minimum acceptable value of 3.5 μT/A. In their analysis, α32 0, and the phase shift θwas considered to be insignificant. Applying the model of Eqn. (5), we obtain their stated AM field strength if k(θ) is approximately 1.078, which is consistent with our estimation of k(θ).

Now assume that instead of two AMF structures, each associated with one of the electrode assemblies, only one slotted-up contact with the geometry of the above-cited patent is employed. If the maximum gap d is reduced to 0.008 m, retain k(θ)=1.078, and assume θ=12.3° (i.e., ⅓ of the phase shift produced by the two-segment coil illustrated in FIGS. 2 and 3), substitution into Eqn. (8) informs that the maximum peak current for which anode involvement can be expected to be eliminated on the non-AMF electrode contact is $I_m$ =24,500 A. This is obtained for B/I=2 μT/A at the surface of the non-AMF contact, which is lower than the value required in the above-cited patent.

Thus, by employing the invention as described herein one can obtain a vacuum in interrupter with a significant current interruption capacity with a simplified structure and lower impedance than prior art designs. In addition, we have shown that this result can be obtained with a smaller axial magnetic field per unit current than with prior art designs.

The invention having been disclosed in connection with the foregoing variations and examples, additional variations will now be apparent to persons of skill in the art. The invention is not intended to be limited to the variations specifically mentioned herein, and accordingly reference should be made to the appended claims rather than to the foregoing discussion of preferred examples to assess the scope of the invention in which exclusive rights are claimed.

What is claimed is:

1. A vacuum interrupter having a maximum interruption capability of peak current $I_m$, comprising first and second coaxially aligned electrode assemblies that are relatively movable along a common longitudinal axis between an open circuit position and a closed circuit position, each including a contact surface confronting the contact surface of the other electrode assembly, only the first electrode assembly including axial magnetic field means for producing a substantially longitudinal magnetic field B in a contact gap between the contact surfaces, wherein with the electrode assemblies in the open circuit position and the instantaneous arc current being $I_m$ measured in kiloamperes, the instantaneous component of B in the axial direction $B_a$, measured in milliteslas, imposed on the majority of each contact surface is:

$$5I_m\text{mT/kA} > B_a \geqq 3.2\ (I_m - 9\ \text{kA})\ \text{mT/kA}.$$

2. The vacuum interrupter of claim 1, wherein the contact gap in the open circuit position is d, and wherein the AMF means includes a generally annular-shaped effective coil having an average radius a and that comprises N circumferentially spaced segments each having a midpoint spaced an average distance $z_o$ in the longitudinal direction from the contact surface, the segments defining N substantially identical parallel current paths through which approximately equal branch currents Γ of the interrupter current I flows before entering the contact surface of the first electrode assembly, and a low current leakage path through which a branch current αΓ of the interrupter current I flows before entering the contact surface of the first electrode assembly, αΓ being less than Γ through any of the segments, the vacuum interrupter being structured such that:

$$\frac{a^2}{[a^2+(z_0+d)^2]^{1.5}} \geqq 5.09\text{m}^{-1}\frac{(N+\alpha)}{\cos\phi}\left[1-\frac{9\text{kA}}{I_m}\right]$$

where ϕ is a phase shift of $B_a$ from I, where a, $z_o$ and d are measured in meters, and where $I_m$ is measured in kiloamperes.

3. The vacuum interrupter of claim 2, wherein the coil is generally circularly shaped, each of the segments being generally coplanar and circumferentially spaced apart.

4. The vacuum interrupter of claim 3, wherein a is approximately 0.033 m, $z_o$ is approximately 0.0164 m, N is 2, ϕ is approximately 37°, θ is approximately 0.123, $I_m$ is about 51 kA, and d is less than or equal to approximately 0.0128 m.

5. The vacuum interrupter of claim 2, wherein the segments define N circumferentially spaced slots each inclined at an angle θ to the longitudinal axis such that each segment overlaps an adjacent segment, the vacuum interrupter being structured such that:

$$\frac{a^2}{[a^2+(z_0+d)^2]^{1.5}} \geqq \frac{5.09\text{m}^{-1}}{k(\theta)}\ \frac{(N+\alpha)}{\cos\phi}\left[1-\frac{9\text{kA}}{I_m}\right]$$

where k(θ) ranges between approximately 1.0 and 1.2.

6. The vacuum interrupter of claim 5, wherein d is approximately 0.008 meters, N=6 and k(θ) is approximately 1.078.

* * * * *